US006709139B2

(12) United States Patent
Ishida et al.

(10) Patent No.: US 6,709,139 B2
(45) Date of Patent: Mar. 23, 2004

(54) PROJECTION-TYPE VEHICULAR HEADLAMP HAVING REDUCED DAZZLING EFFECT

(75) Inventors: Hiroyuki Ishida, Shizuoka (JP); Hideki Tanaka, Shizuoka (JP); Kaoru Yamamoto, Shizuoka (JP); Kenichi Takada, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/160,092

(22) Filed: Jun. 4, 2002

(65) Prior Publication Data

US 2002/0181243 A1 Dec. 5, 2002

(30) Foreign Application Priority Data

Jun. 5, 2001 (JP) ..... 2001-169045

(51) Int. Cl.[7] ..... F21W 101/10
(52) U.S. Cl. ..... 362/509; 362/538
(58) Field of Search ..... 362/509, 538, 362/507, 351, 360, 361

(56) References Cited

U.S. PATENT DOCUMENTS 4,922,386 A * 5/1990 Bockeler et al. ..... 362/61
5,285,358 A * 2/1994 Watanabe et al. ..... 362/61
6,280,071 B1 8/2001 Yamamoto et al.
6,428,194 B1 * 8/2002 Oschmann et al. ..... 362/507

* cited by examiner

*Primary Examiner*—Laura K. Tso
(74) *Attorney, Agent, or Firm*—Sughrue Mion, PLLC

(57) ABSTRACT

An object of the present invention is to prevent dazzlement from being caused by beams of light directly emitted from a light source, without requiring any bulky component member. A vehicular headlamp 1 comprises a light source 7, a reflector 6, a cut-line forming shade 9 for forming a cut line, and a condenser lens 8. The cut-line forming shade cuts off some beams of light emitted from the light source and reflected by the reflector and forms shaped beams of light. The condenser lens projects the shaped beams of light forwards and radiates them according to a light distribution pattern. An opening is formed between the condenser lens and the reflector. A dazzling-light cutting shade 15 for cutting off beams of light emitted toward a region above the light distribution pattern is disposed between the light source and the opening.

14 Claims, 3 Drawing Sheets

PROJECTION-TYPE VEHICULAR HEADLAMP HAVING REDUCED DAZZLING EFFECT

BACKGROUND OF THE INVENTION

The present invention relates to vehicular headlamps. More specifically, the present invention relates to a projection-type vehicular headlamp in which dazzling of the vision of oncoming drivers by light directly emitted from the light source of the lamp is prevented.

In a vehicular headlamp of the projection type, a cut-line forming shade is arranged such that its upper edge is located close to a focal point of a reflector that reflects and condenses light emitted from a light source. The reflected light, some portion of which is cut off by the cut-line forming shade, is projected forwards by a condenser lens. Such a headlamp requires provisions for providing convection of air to protect the reflector from heat, and also it is desired to reduce the weight of the projection unit composed of the light source, reflector, cut-line forming shade, and condenser lens. For these purposes, a recess can be formed in a lens holder used to mount the condenser lens to the reflector, or the lens holder itself can be formed with a ring-like lens holding portion having a plurality of arms and connected to the reflector via the arms. In this arrangement, an opening is formed between the reflector and the condenser lens.

However, if the opening is formed between the reflector and the condenser lens as described above, some of the light directly emitted from the light source passes through the opening. Such light is radiated to the outside without impinging on the condenser lens, resulting in dazzle to the vision of drivers of oncoming vehicles or pedestrians.

If the reflector has an elliptical lower surface, light from the light source bulb emitted toward the lower surface of the reflector is reflected by the reflector and radiated to the outside through the opening between the condenser lens and the reflector. This too can cause a problem of dazzlement.

To solve this problem, an extension can provided which covers the periphery of the projector unit, thus cutting off direct light traveling through the opening. If the extension for covering the periphery of the projector unit is used to prevent dazzlement due to direct beams of light as in the case of the aforementioned vehicular headlamp, it is of course impossible to dispense with the extension. Moreover, the direct light is cut off in regions where it is diffused to some extent. As a result, the necessity of enlarging the extension emerges as another problem.

It is thus an object of the present invention to prevent dazzlement from being caused by beams of light directly emitted from a light source without requiring any bulky component members.

SUMMARY OF THE INVENTION

A vehicular headlamp according to the present invention is intended to solve the problems mentioned above. For this purpose, a vehicular headlamp of the invention comprises a light source, a reflector, a cut-line forming shade for forming a cut line, and a condenser lens. The cut-line forming shade cuts off some of the light emitted from the light source and reflected by the reflector and forms shaped beams of light. The condenser lens projects the shaped beams of light forwards and radiates them according to a predetermined light distribution pattern. An opening is formed between the condenser lens and the reflector. A dazzling-light cutting shade for cutting off light emitted toward regions above the light distribution pattern is disposed between the light source and the opening.

Thus, the vehicular headlamp according to the present invention prevent dazzlement from occurring due to light directly emitted from the light source. Also, since the dazzling-light cutting shade is disposed between the light source and the opening, direct beams of light are cut off in regions where they are diffused just slightly. Therefore, no bulky component members are required.

DESCRIPTION OF THE PREFERRED EMBODIMENTS

Figure 1:
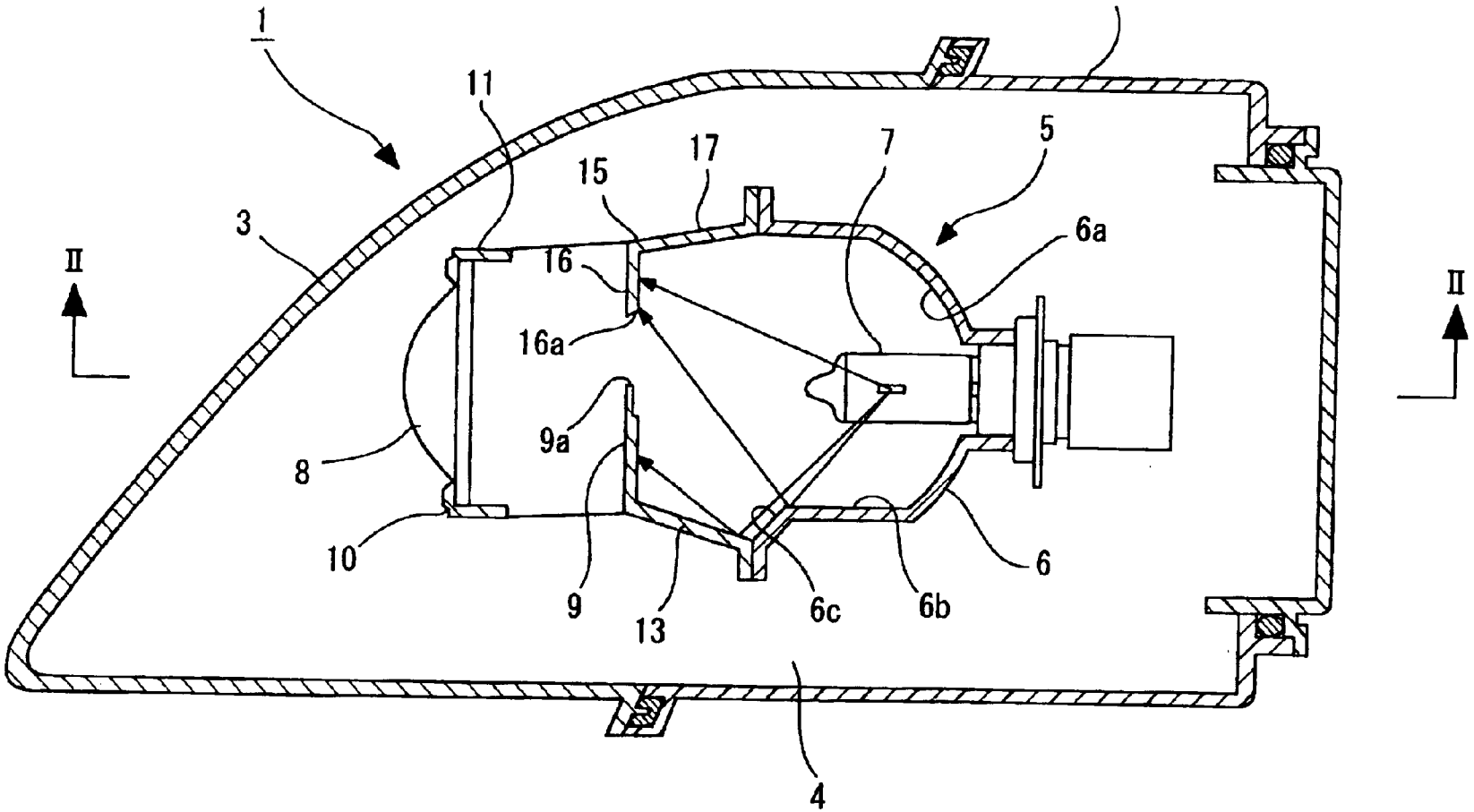
FIG. 1 is a longitudinal sectional view of a vehicular headlamp constructed according to a preferred embodiment of the present invention.

A vehicular headlamp constructed according to a preferred embodiment of the present invention will be described hereinafter with reference to the accompanying drawings.

A vehicular headlamp 1 is composed of a lamp body 2, a cover lens 3, and a projector unit 5. The cover lens 3 covers a front opening of the lamp body 2. The projector unit 5 is tiltably disposed in a lighting fixture chamber 4 defined by the lamp body 2 and the cover lens 3.

The projector unit 5 includes a reflector 6, a light source bulb 7, a condenser lens 8, and a cut-line forming shade 9. The reflector 6 supports the light source bulb 7.

The reflector 6 has a main reflecting surface 6*a* for condensing light emitted from the light source bulb 7 at a predetermined focus area. The reflector 6 is tiltably supported with respect to the lamp body 2 by means of a known support mechanism such as a tilt support mechanism, which is composed of a rotatable fulcrum portion and a distance adjustment portion. The rotatable fulcrum portion is constructed of a ball joint. The distance adjustment portion is composed of an adjusting screw rotatably supported by the lamp body 2 and a nut member supported by the reflector 6 and into which the adjusting screw is threadedly joined.

The condenser lens 8, which is a convex lens, is supported via a lens holder 10 at a location in front of the reflector 6.

Figure 2:
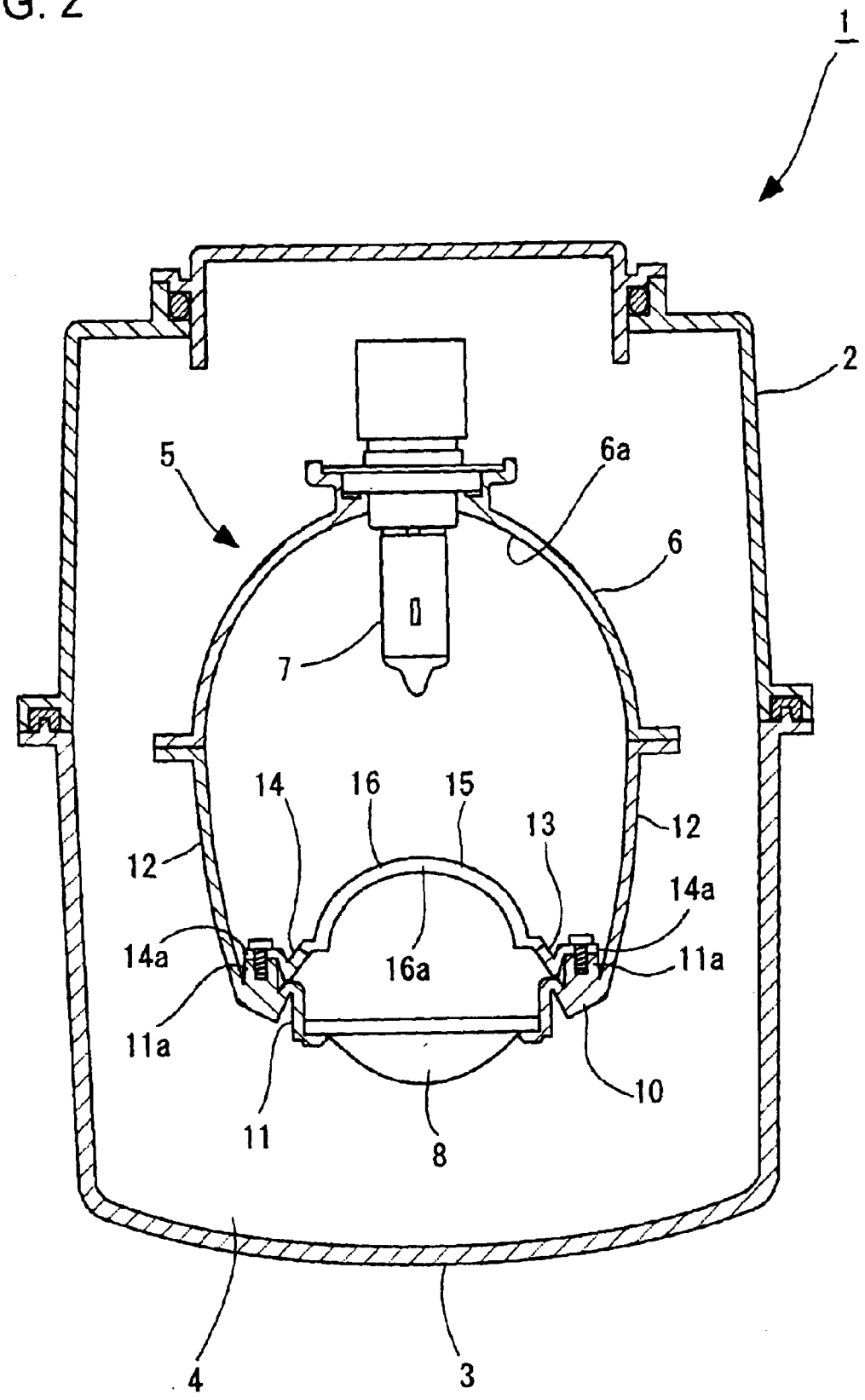
FIG. 2 is a cross-sectional view taken along a line II—II in FIG. 1.

The lens holder 10 is constructed by integrally forming a lens supporting portion 11 having a generally annular shape and stays 12 protruding rearwards from the lens supporting portion 11 (see FIG. 2). By "integrally forming" is meant that the two members are formed from a single body of material. The lens supporting portion 11 supports a peripheral edge portion of the condenser lens 8. The stays 12 are fixed at their rear ends to an opening end of the reflector 6.

The lens holder 10 supports a shade supporting body 13. The shade supporting body 13 has a supported portion 14 having an annular shape and which is substantially equal in size to the lens supporting portion 11 of the lens holder 10. Mounted strips 14*a* formed in right and left lateral portions of the supported portion 14 are fixed by means of screws to mounting boss portions 11*a* which protrude from rear surfaces of right and left lateral portions of the lens supporting portion 11 (see FIG. 2).

Figure 3:
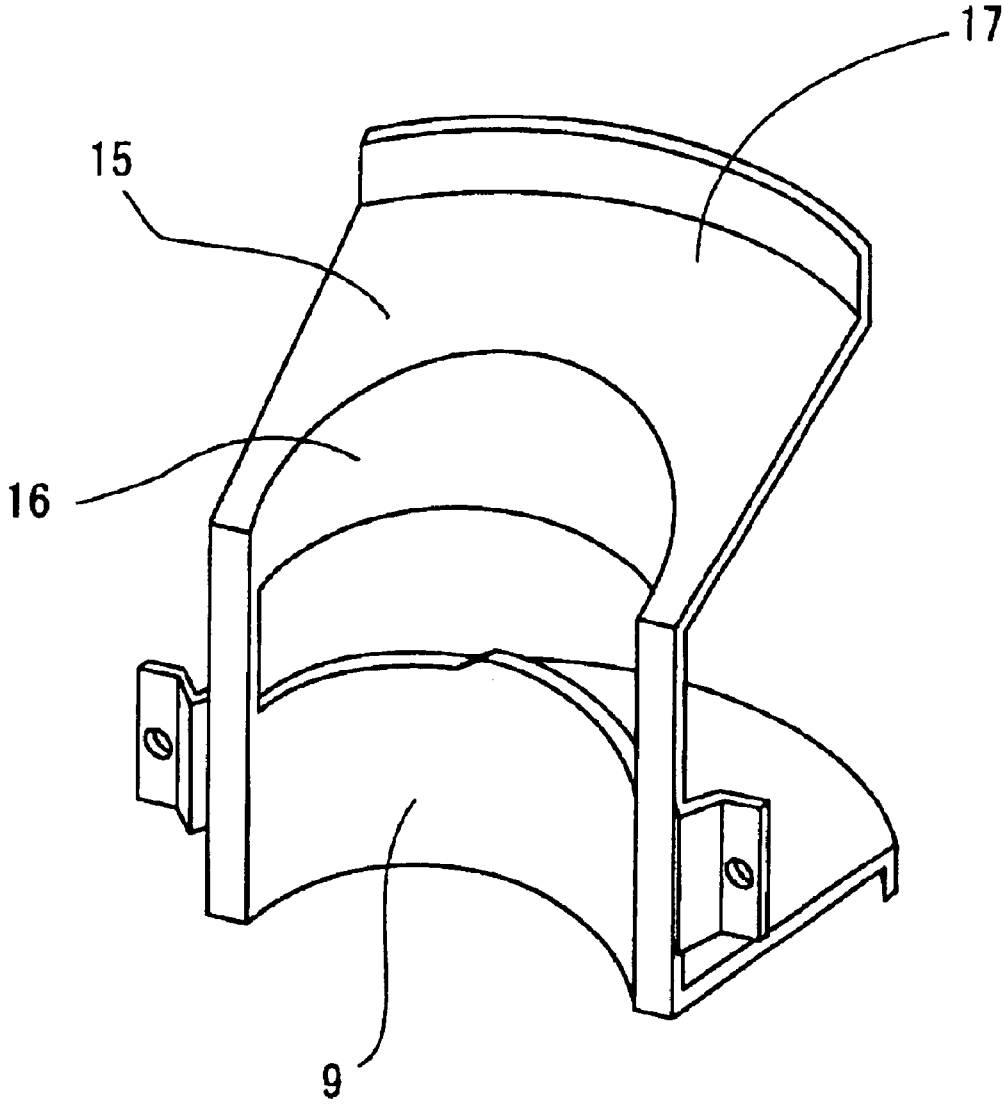
FIG. 3 is a perspective view of a cut-line forming shade and a dazzling-light cutting shade used in the embodiment of FIGS. 1 and 2.

The cut-line forming shade 9 and a dazzling-light cutting shade 15 are formed integrally with the shade supporting body 13 (see FIGS. 1 and 3). The cut-line forming shade 9 rises substantially vertically and is formed as a plate having a curved surface that is concave toward the front in horizontal cross section. The cut-line forming shade 9 is integrated at its opposed ends with the supported portion 14 of the shade supporting body 13 continuously. The upper edge 9*a* of the cut-line forming shade 9 is located contiguous to the optical axis of the reflector 6 in the vicinity of the focal point thereof.

The dazzling-light cutting shade 15 is constructed by integrally forming a main portion 16 and a rearward extending portion 17. The main portion 16, which extends substantially vertically, and is in the form of a plate having a curved surface that is curved in a horizontal cross section in the same manner as the cut-line forming shade 9 (see FIG. 2). The rearward extending portion 17 extends rearwards from the upper end of the main portion 16 substantially horizontally (see FIG. 1). The main portion 16 is integrated at its opposed ends with the supported portion 14 of the shade supporting body 13. In a region above the optical axis of the reflector 6, the lower edge 16*a* of the main portion 16 of the dazzling-light cutting shade 15 is located substantially at the same position as the upper edge 9*a* of the cut-line forming shade 9 in the direction of the optical axis (which extends substantially in the longitudinal direction of a vehicle on which the headlamp is mounted). The rearward extending portion 17 is so located as to cover the space between the main portion 16 and the front end of the upper edge of the reflector 6.

A horizontal reflecting surface 6*b* extending substantially horizontally and an inclined reflecting surface 6*c* extending continuously from the front end of the horizontal reflecting surface 6*b* and inclined forwards and downwards are formed as lower surfaces of the reflector 6 (see FIG. 1). All the light directly radiated from the light bulb 7 onto the horizontal reflecting surface 6*b* is reflected by the horizontal reflecting surface 6*b*, striking the rear surface of the dazzling-light cutting shade 15. All the light directly radiated from the light source 7 onto the inclined reflecting surface 6*c* is reflected by the inclined reflecting surface 6*c* and strikes the back surface of the cut-line forming shade 9. Thus, the dazzling-light cutting shade 15 cuts off all the light traveling from the light source bulb 7 toward the horizontal reflecting surface 6*b*, and the cut-line forming shade 9 cuts off all the light traveling from the light source bulb 7 toward the inclined reflecting surface 6*c*. As a result, no light is radiated to the outside from the space between the reflector 6 and the condenser lens 8.

All the beams of light radiated directly upwards from the light source bulb 7 and traveling toward the opening between the front end of the reflector 6 and the condenser lens 8 impinge on the dazzling-light cutting shade 15 and are cut off. Thus, there is no that some of the light traveling upwards from the light source bulb 7 will dazzle drivers of oncoming vehicles or pedestrians.

It is preferable that the rear surface of the dazzling-light cutting shade 15 be subjected to non-reflective processing such as by application of a non-reflecting coating so as to prevent light from being reflected by the dazzling-light cutting shade 15. However, even if some light is reflected by the rear surface of the dazzling-light cutting shade 15, such light is diffused laterally uniformly because of the curvature of the dazzling-light cutting shade 15. Even if the light thus diffused is reflected again by the reflector, it will not cause dazzlement.

As described above, the vehicular headlamp 1 cuts off of light that can dazzle drivers of oncoming vehicles or pedestrians by means of the dazzling-light cutting shade 15 and the cut-line forming shade 9, prevent such light from being radiated to outside. In addition, the vehicular headlamp 1 does not require any bulky component members such as the extension of the conventional lamp.

Further, since the dazzling-light cutting shade 15 is disposed close to the cut-line forming shade 9, light is cut off in a region where it is focused to some extent. Therefore, there is no need to increase the size of the vehicular headlamp 1.

Furthermore, by forming the dazzling-light cutting shade 15 is integrally with the cut-line forming shade 9 as described above, it becomes possible to define a positional relation between the dazzling-light cutting shade 15 and the cut-line forming shade 9 precisely. Also, the vehicular headlamp 1 can be mounted easily.

According to the foregoing description of the invention, the single vehicular headlamp 1 has the horizontal reflecting surface 6*b* and the inclined reflecting surface 6*c*. However, the objects of the present invention can be achieved even without these reflecting surfaces, and aforementioned additional effects can be achieved by either or both of the two reflecting surfaces mentioned above.

It is to be noted herein that the shapes and structures of all the component members in the aforementioned embodiment are to be regarded merely as examples obtained in embodying the present invention and that the technical scope of the present invention is not to be construed narrowly on grounds of those shapes and structures.

As is apparent from the foregoing description, the vehicular headlamp according to the present invention comprises the light source, the reflector, the cut-line forming shade for forming a cut line, and the condenser lens. The cut-line forming shade cuts off some beams of light emitted from the light source and reflected by the reflector and forms shaped beams of light. The condenser lens projects the shaped beams of light forwards and radiates them according to a light distribution pattern. The opening is formed between the condenser lens and the reflector. The dazzling-light cutting shade for cutting off beams of light emitted toward the region above the light distribution pattern is disposed between the light source and the opening.

Thus, the vehicular headlamp according to the present invention can prevent dazzlement of the vision of the drivers or pedestrians from occurring due to light directly emitted from the light source. Also, since the dazzling-light cutting shade is disposed between the light source and the opening, direct beams of light can be cut off in a region where they are diffused just slightly. Therefore, no bulky component member is required.

The dazzling-light cutting shade may have a portion extending rearwards substantially horizontally. Thus, the portion extending downward substantially vertically can be positioned precisely by adjusting the length of the portion extending rearwards substantially horizontally.

In the preferred embodiment, the dazzling-light cutting shade and the cut-line forming shade are located at the same position when viewed in the longitudinal direction of the vehicle. Thus, the dazzling-light cutting shade can cut off only direct light that could otherwise cause dazzlement, without cutting off light reflected by the reflector which is intended to be used for illumination.

Moreover, the dazzling-light cutting shade may be curved in horizontal cross-sectional shape. Thus, even if light directly emitted from the light source is reflected by the rear surface of the dazzling-light cutting shade and then by the reflector, such light is laterally diffused by the rear surface of the dazzling-light cutting shade, which is designed as a curved surface. As a result, there is no likelihood of dazzlement.

The dazzling-light cutting shade and the cut-line forming shade may be formed integrally. Thus, a positional relation between the two shades can be determined precisely.

The reflecting surface for reflecting beams of light emitted from the light source toward the rear of the dazzling-light cutting shade is formed in the lower portion of the reflector. Thus, it is possible to cut off light reflected by the lower portion of the reflector which cannot be used effectively for the purpose of illumination because of the possibility of dazzlement.

The reflecting surface for reflecting light emitted from the light source toward the rear of the cut-line forming shade is formed in the lower portion of the reflector. Thus, it is possible to cut off light reflected by lower portion of the reflector which cannot be used effectively for the purpose of illumination because of the threat of dazzlement.

It should further be apparent to those skilled in the art that various changes in form and detail of the invention as shown and described above may be made. It is intended that such changes be included within the spirit and scope of the claims appended hereto.

What is claimed is:

1. A vehicular headlamp comprising:

a light source;

a condenser lens;

a reflector reflecting and condensing light from said light source toward said condenser lens, wherein said condenser lens projects a shaped beam of light forward and radiates said light in a predetermined light distribution pattern;

an opening being formed between said condenser lens and said reflector;

a cut-line forming shade for forming a cut line in said predetermined light distribution pattern disposed between said reflector and said condenser lens, said cut-line forming shade cutting off a portion of light emitted from said light source and reflected by said reflector; and a dazzling-light cutting shade for cutting off light emitted from said light source directly toward a region above said light distribution pattern, said dazzling-light cutting shade being disposed between said light source and said opening, wherein a rear surface of said dazzling-light cutting shade is non-reflective.

2. The vehicular headlamp according to claim 1, wherein said dazzling-light cutting shade comprises a portion extending rearwards toward said reflector substantially horizontally.

3. The vehicular headlamp according to claim 1, wherein said dazzling-light cutting shade and the cut-line forming shade are located substantially at the same position in a longitudinal direction of a vehicle on which said headlamp is mounted.

4. The vehicular headlamp according to claim 1, wherein said dazzling-light cutting shade is curved in a horizontal cross-section.

5. The vehicular headlamp according to claim 1, wherein said dazzling-light cutting shade and said cut-line forming shade are formed integrally with one another.

6. The vehicular headlamp according to claim 1, wherein a reflecting surface emitted from said light source toward a rear surface of said dazzling-light cutting shade is formed in a lower portion of said reflector.

7. The vehicular headlamp according to claim 1, wherein a reflecting surface for reflecting light emitted from said light source toward a rear surface of said cut-line forming shade is formed in a lower portion of said reflector.

8. The vehicular headlamp according to claim 1, further comprising a lens holder for fixing said projection lens to said reflector.

9. The vehicular headlamp according to claim 8, wherein said lens holder comprises an annularly shaped lens supporting portion and a plurality of stays protruding rearward from said lens supporting portion, said stays being fixed at rear ends thereof to an opening end of said reflector.

10. The vehicular headlamp according to claim 9, further comprising a shade supporting body supported by said lens holder, said shade supporting body supporting said cut-line forming shade and said dazzling-light cutting shade on said reflector.

11. The vehicular headlamp according to claim 10, wherein said cut-line forming shade and said dazzling-light cutting shade are formed integrally with said shade supporting body.

12. The vehicular headlamp according to claim 11, wherein said shade supporting body comprising an annularly shaped shade supporting portion and a plurality of mounting strips formed on opposed lateral portions of said shade supporting portion.

13. A vehicular headlamp comprising:

a light source;

a condenser lens;

a reflector reflecting and condensing light from said light source toward said condenser lens, wherein said condenser lens projects a shaped beam of light forward and radiates said light in a predetermined light distribution pattern;

an opening being formed between said condenser lens and said reflector;

a cut-line forming shade for forming a cut line in said predetermined light distribution pattern disposed between said reflector and said condenser lens, said cut-line forming shade cutting off a portion of light emitted from said light source and reflected by said reflector; and a dazzling-light cutting shade for cutting off light emitted from said light source directly toward a region above said light distribution pattern, said dazzling-light cutting shade being disposed between said light source and said opening, wherein said dazzling-light cutting shade and the cut-line forming shade are located substantially at the same position in a longitudinal direction of a vehicle on which said headlamp is mounted.

14. A vehicular headlamp comprising:

a light source;

a condenser lens;

a reflector reflecting and condensing light from said light source toward said condenser lens, wherein said condenser lens projects a shaped beam of light forward and radiates said light in a predetermined light distribution pattern;

an opening being formed between said condenser lens and said reflector;

a cut-line forming shade for forming a cut line in said predetermined light distribution pattern disposed between said reflector and said condenser lens, said cut-line forming shade cutting off a portion of light emitted from said light source and reflected by said reflector;

a dazzling-light cutting shade for cutting off light emitted from said light source directly toward a region above said light distribution pattern, said dazzling-light cutting shade being disposed between said light source and said opening;

a lens holder for fixing said projection lens to said reflector; and a shade supporting body supported by said lens holder, said shade supporting body supporting said cut-line forming shade and said dazzling-light cutting shade on said reflector, wherein:

said lens holder comprises an annularly shaped lens supporting portion and a plurality of stays protruding rearward from said lens supporting portion, said stays being fixed at rear ends thereof to an opening end of said reflector;

said cut-line forming shade and said dazzling-light cutting shade are formed integrally with said shade supporting body; and said shade supporting body comprising an annularly shaped shade supporting portion and a plurality of mounting strips formed on opposed lateral portions of said shade supporting portion.

* * * * *